US011736873B2

(12) United States Patent
Brielmann et al.

(10) Patent No.: US 11,736,873 B2
(45) Date of Patent: Aug. 22, 2023

(54) WIRELESS PERSONAL COMMUNICATION VIA A HEARING DEVICE

(71) Applicant: SONOVA AG, Staefa (CH)

(72) Inventors: Arnaud Brielmann, Le Landeron (CH); Amre El-Hoiydi, Neuchâtel (CH)

(73) Assignee: Sonova AG, Staefa (CH)

( * ) Notice: Subject to any disclaimer, the term of this patent is extended or adjusted under 35 U.S.C. 154(b) by 48 days.

(21) Appl. No.: 17/551,417

(22) Filed: Dec. 15, 2021

(65) Prior Publication Data

US 2022/0201407 A1 Jun. 23, 2022

(30) Foreign Application Priority Data

Dec. 21, 2020 (EP) ..... 20216192

(51) Int. Cl.
*H04R 25/00* (2006.01)

(52) U.S. Cl.
CPC ..... *H04R 25/554* (2013.01); *H04R 25/43* (2013.01); *H04R 25/505* (2013.01); *H04R 2225/41* (2013.01); *H04R 2225/43* (2013.01); *H04R 2225/51* (2013.01); *H04R 2225/55* (2013.01); *H04R 2225/61* (2013.01); *H04R 2420/07* (2013.01)

(58) Field of Classification Search
CPC ..... H04R 2225/41; H04R 2225/43; H04R 2225/51; H04R 2225/55; H04R 2225/61; H04R 2420/07; H04R 25/43; H04R 25/505; H04R 25/554; H04R 1/1083; H04R 2460/07; H04R 25/407; H04R 25/70
USPC ..... 381/312
See application file for complete search history.

(56) References Cited

U.S. PATENT DOCUMENTS

| | | | |
|---|---|---|---|
| 2012/0189140 | A1 | 7/2012 | Hughes |
| 2012/0321112 | A1 | 12/2012 | Schubert |
| 2014/0100849 | A1 | 4/2014 | Rasmussen |
| 2020/0296521 | A1 | 9/2020 | Wexler |

FOREIGN PATENT DOCUMENTS

| | | |
|---|---|---|
| EP | 3101919 | 12/2016 |
| EP | 3716650 | 9/2020 |
| EP | 3866489 | 8/2021 |
| WO | 2008071236 | 6/2008 |

(Continued)

OTHER PUBLICATIONS

WO 2021159369. Text version. (Year: 2021).*

(Continued)

*Primary Examiner* — Phylesha Dabney
(74) *Attorney, Agent, or Firm* — ALG Intellectual Property, LLC

(57) ABSTRACT

A method for a wireless personal communication using a hearing system with a hearing device comprises: monitoring and analyzing the user's acoustic environment by the hearing device to recognize one or more speaking persons based on content-independent speaker voiceprints saved in the hearing system; and presenting a user interface to the user for notifying the user about a recognized speaking person and for establishing, joining or leaving a wireless personal communication connection between the hearing device and one or more communication devices used by the one or more recognized speaking persons.

14 Claims, 3 Drawing Sheets

(56) References Cited

FOREIGN PATENT DOCUMENTS

| | | | |
|---|---|---|---|
| WO | 2016050312 | 4/2016 | |
| WO | 2018087570 | 5/2018 | |
| WO | 2019156499 | 8/2019 | |
| WO | WO-2021159369 A1 * | 8/2021 | ..... G10K 11/17873 |

OTHER PUBLICATIONS

Hansen, et al., "Speaker Recognition by Machines and Humans", 1053-5888/15, IEEE Signal Processing Magazine, Nov. 2015, p. 74-99.

Kumar, et al.,"Analysis of MFCC and BFCC in a Speaker Identification System", 978-1-5386-1370-2/18, iCoMET 2018.

Oppenheim, et al.,"From Frequency to Quefrency: A History of the Cepstrum", 1053-5888/04, Sep. 2004, IEEE Signal Processing Magazine.

* cited by examiner

WIRELESS PERSONAL COMMUNICATION VIA A HEARING DEVICE

RELATED APPLICATIONS

The present application claims priority to EP Patent Application No. 20216192.3, filed Dec. 21, 2020, the contents of which are hereby incorporated by reference in their entirety.

BACKGROUND INFORMATION

Hearing devices are generally small and complex devices. Hearing devices can include a processor, microphone, an integrated loudspeaker as a sound output device, memory, housing, and other electronical and mechanical components. Some example hearing devices are Behind-The-Ear (BTE), Receiver-In-Canal (RIC), In-The-Ear (ITE), Completely-In-Canal (CIC), and Invisible-In-The-Canal (IIC) devices. A user can prefer one of these hearing devices compared to another device based on hearing loss, aesthetic preferences, lifestyle needs, and budget.

Hearing devices of different users may be adapted to form a wireless personal communication network, which can improve the communication by voice (such as a conversation or listening to someone's speech) in a noisy environment with other hearing device users or people using any type of suitable communication devices, such as wireless microphones etc.

The hearing devices are then used as headsets which pick-up their user's voice with their integrated microphones and make the other communication participant's voice audible via the integrated loudspeaker. For example, a voice audio stream is then transmitted from a hearing device of one user to the other user's hearing device or, in general, in both directions. In this context, it is also known to improve the signal-to-noise ratio (SNR) under certain circumstances using beam formers provided in a hearing device: if the speaker is in front of the user and if the speaker is not too far away (typically, closer than approximately 1.5 m).

In the prior art, some approaches to automatically establish a wireless audio communication between hearing devices or other types of communication devices are known. Quite some prior art exists on the automatic connection establishment based on the correlation of acoustic signal and digital audio stream. However, such an approach is not reasonable for a hearing device network as described herein, because the digital audio signal for personal communication is not intended to be streamed before the establishment of the network connection and it would consume too much power to do so. Further approaches either mention a connection triggered by speech content such as voice commands, or are based on analysis of current acoustic environment or a signal from a sensor not related to speaker voice analysis.

BRIEF DESCRIPTION OF THE DRAWINGS

Below, embodiments of the present invention are described in more detail with reference to the attached drawings.

The reference symbols used in the drawings, and their meanings, are listed in summary form in the list of reference symbols. In principle, identical parts are provided with the same reference symbols in the figures.

DETAILED DESCRIPTION

Figure 1:
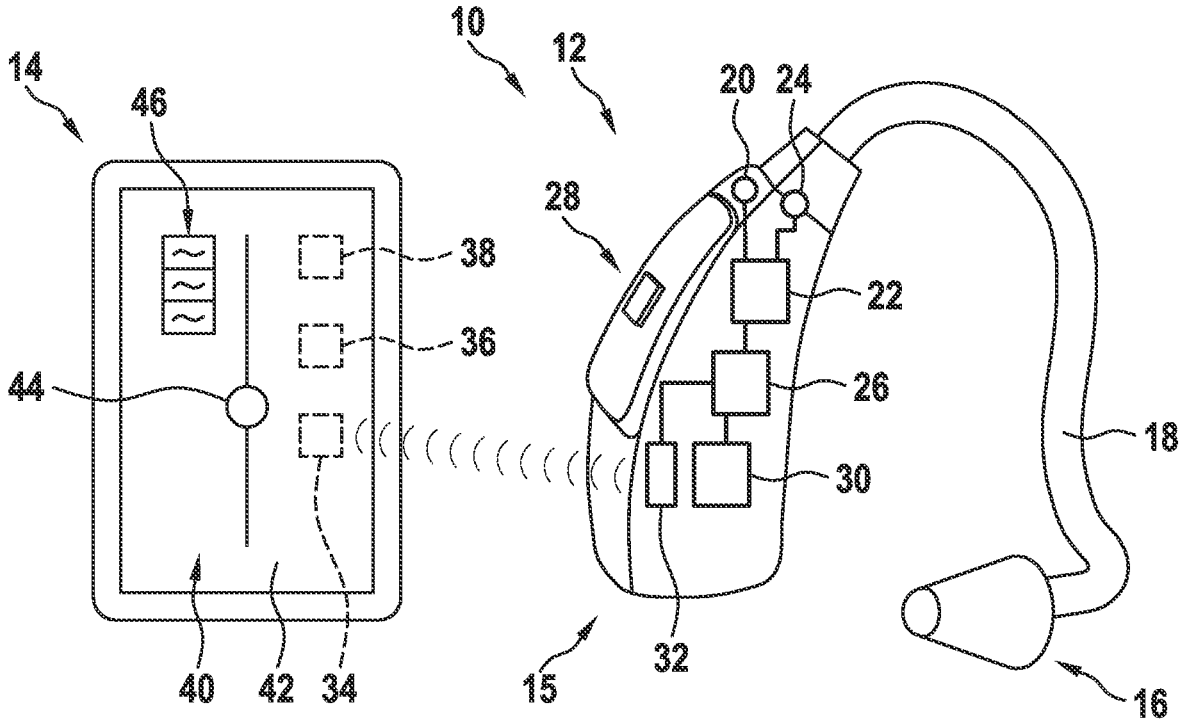
FIG. 1 schematically shows a hearing system according to an embodiment.

Described herein are a method, a computer program and a computer-readable medium for a wireless personal communication using a hearing device worn by a user and provided with at least one microphone and a sound output device. Furthermore, the embodiments described herein relate to a hearing system comprising at least one hearing device of this kind and optionally a connected user device, such as a smartphone.

It is a feature described herein to provide a method and system for a wireless personal communication using a hearing device worn by a user and provided with at least one microphone and a sound output device, which allow to further improve the user's comfort, the signal quality and/or to save energy in comparison to methods and systems known in the art.

These features are achieved by principles described herein.

A first aspect relates to a method for a wireless personal communication using a hearing device worn by a user and provided with at least one integrated microphone and a sound output device (e.g. a loudspeaker).

The method may be a computer-implemented method, which may be performed automatically by a hearing system, part of which the user's hearing device is. The hearing system may, for instance, comprise one or two hearing devices used by the same user. One or both of the hearing devices may be worn on and/or in an ear of the user. A hearing device may be a hearing aid, which may be adapted for compensating a hearing loss of the user. Also a cochlear implant may be a hearing device. The hearing system may optionally further comprise at least one connected user device, such as a smartphone, smartwatch or other devices carried by the user and/or a personal computer etc.

According to an embodiment, the method comprises monitoring and analyzing the user's acoustic environment by the hearing device to recognize one or more speaking persons based on content-independent speaker voiceprints saved in the hearing system. The user's acoustic environment may be monitored by receiving an audio signal from at least one microphone, such as the at least one integrated microphone. The user's acoustic environment may be analyzing by evaluating the audio signal, so as to recognize the one or more speaking persons based on their content-independent speaker voiceprints saved in a hearing system (denoted herein as "speaker recognition").

According to an embodiment, this speaker recognition is used as a trigger to possibly automatically establish, join or leave a wireless personal communication connection between the user's hearing device and respective communication devices used by the one or more speaking persons (also referred to as "other conversation participants" herein) and capable of wireless communication with the user's hearing device. Herein, the term "conversation" is meant to comprise any kind of personal communication by voice (i.e. not only a conversation of two people, but also talking in a group or listening to someone's speech etc.).

In other words, the basic idea of the proposed method is to establish, join or leave a hearing device network based on speaker recognition techniques, i.e. on a text- or content-independent speaker verification or at least to inform the user about the possibility about such a connection. To this end, for example, hearing devices capable of wireless audio communication may expose the user's own content-independent voiceprint (e.g. a suitable speaker model of the user) such that another pair of hearing devices, which belongs to another user, can compare it with the current acoustic environment.

Speaker recognition can be performed with identification of characteristic frequencies of the speaker's voice, prosody of the voice, and/or dynamics of the voice. Speaker recognition also may be based on classification methods, such as GMM, SVM, k-NN, Parzen window and other machine learning and/or deep learning classification method such as DNN.

The automatic activation of the wireless personal communication connection based on speaker recognition as described herein may, for example, be better suited as a manual activation by the users of hearing devices, since a manual activation could have the following drawbacks:

Firstly, it might be difficult for the user to know when such a wireless personal communication connection might be beneficial to activate. The user might also forget the option of using it.

Secondly, it might be cumbersome for the user to activate the connection again and again in the same situation. In such a case, it would be easier to have it activated automatically situationally.

Thirdly, it might be very disturbing when a user forgets to deactivate the connection in a situation where he wants to maintain his privacy and he is not aware that he is heard by others.

On the other hand, compared to known methods of an automatic wireless connection activation as outlined further above, the solution described herein may, for example, take an advantage that the speaker's hearing devices have an a priori knowledge of the speaker's voice and are able to communicate his voice signature (a content-independent speaker voiceprint) to potential conversation partners' devices. The complexity is therefore reduced compared to the methods known in the art, as well as the number of inputs. Basically, only the acoustic and radio interfaces are required with the speaker recognition approach described herein.

According to an embodiment, the communication devices capable of wireless communication with the user's hearing device include other persons' hearing devices and/or wireless microphones, i.e. hearing devices and/or wireless microphones used by the other conversation participants.

According to an embodiment, beam formers specifically configured and/or tuned so as to improve a signal-to-noise ratio (SNR) of a wireless personal communication between persons not standing face to face (i.e. the speaker is not in front of the user) and/or separated by more than 1 m, more than 1.5 m or more than 2 m are employed in the user's hearing device and/or in the communication devices of the other conversation participants. Thereby, the SNR in adverse listening conditions may be significantly improved compared to solutions known in the art, where the beam formers typically only improve the SNR under certain circumstances where the speaker is in front of the user and if the speaker is not too far away (approximately less than 1.5 m away).

According to an embodiment, the user's own content-independent voiceprint may also be saved in the hearing system and is being shared (i.e. exposed and/or transmitted) by wireless communication with the communication devices used by potential conversation participants so as to enable them to recognize the user based on his own content-independent voiceprint. The voiceprint might also be stored outside of the device, e.g.: on a server or cloud-based services. For example, the user's own content-independent voiceprint may be saved in a non-volatile memory (NVM) of the user's hearing device or of a connected user device (such as a smartphone) in the user's hearing system, in order to be permanently available. Content-independent speaker voiceprints of potential other conversation participants may also be saved in the non-volatile memory, e.g. in case of significant others such as close relatives or colleagues. However, it may also be suitable to save content-independent speaker voiceprints of potential conversation participants in a volatile memory so as to be only available as long as needed, e.g. in use cases such as a conference or another public event.

According to an embodiment, the user's own content-independent voiceprint may be shared with the communication devices of potential conversation participants by one or more of the following methods:

It may be shared by an exchange of the user's own content-independent voiceprint and the respective content-independent speaker voiceprint when the user's hearing device is paired with a communication device of another conversation participant for wireless personal communication. Here, pairing between hearing devices of different users may be done manually or automatically, e.g. using Bluetooth, and mean a mere preparation for wireless personal communication, but not its activation. In other words, the connection is not necessarily automatically activated by solely paired hearing devices. During pairing a voice model stored in one hearing device may be loaded into the other hearing device, and a connection may be established when the voice model is identified and optionally further conditions as described herein below are met (such as bad SNR).

Additionally or alternatively, the user's own content-independent voiceprint may also be shared by a periodical broadcast performed by the user's hearing device at predetermined time intervals and/or by sending it on requests of communication devices of potential other conversation participants.

According to an embodiment, the user's own content-independent voiceprint is obtained using a professional voice feature extraction and voiceprint modelling equipment, for example, at a hearing care professional's office during a fitting session or at another medical or industrial office or institution. This may have an advantage that the complexity of the model computation can be pushed to the professional equipment of this office or institution, such as a fitting station. This may also have an advantage—or drawback—that the model/voiceprint is created in a quiet environment.

Additionally or alternatively, the user's own content-independent voiceprint may also be obtained by using the user's hearing device and/or the connected user device for voice feature extraction during real use cases (also called Own Voice Pick Ups, OVPU-) in which the user is speaking (such as phone calls). In particular, beamformers provided in the hearing devices may be tuned to pick-up the user's own voice and filter out ambient noises during real use cases of this kind. This approach may have an advantage that the voiceprint/model can be improved over time in real life situations. The voice model (voiceprint) may then also be computed online: by the hearing devices themselves or by the user's phone or another connected device.

If the model computation is swapped to the mobile phone or other connected user device, at least two different approaches can be considered. For example, the user's own content-independent voiceprint may be obtained using the user's hearing device and/or the connected user device for voice feature extraction during real use cases in which the user is speaking and using the connected user device for voiceprint modelling. It may then be that the user's hearing device extracts the voice features and transmits them to the connected user device, whereupon the connected user device computes or updates the voiceprint model and optionally transmits it back to the hearing device. Alternatively, the connected user device may employ a mobile application (e.g. a phone app) which monitors, e.g. with user consent, the user's phone calls and/or other speaking activities and performs the voice feature extraction part in addition to the voiceprint modelling.

According to an embodiment, beside the speaker recognition described herein above and below, one or more further conditions which are relevant for said wireless personal communication are monitored and/or analysed in the hearing system. In this embodiment, the steps of automatically establishing, joining and/or leaving a wireless personal communication connection between the user's hearing device and the respective communication devices of other conversation participants further depend on these further conditions, which are not based on voice recognition. These further conditions may, for example, pertain to acoustic quality, such as a signal-to-noise ratio (SNR) of the microphone signal, and/or to any other factors or criteria relevant for a decision to start or end a wireless personal communication connection.

For example, these further conditions may include the ambient signal-to-noise ratio (SNR), in order to automatically switch to a wireless communication whenever the ambient SNR of the microphone signal is too bad for a conversation, and vice versa. The further conditions may also include, as a condition, a presence of a predefined environmental scenario pertaining to the user and/or other persons and/or surrounding objects and/or weather (such as the user and/or other persons being inside a car or outdoors, wind noise etc.). Such scenarios may, for instance, be automatically identifiable by respective classifiers (sensors and/or software) provided in the hearing device or hearing system.

According to an embodiment, once a wireless personal communication connection between the user's hearing device and a communication device of another speaking person is established, the user's hearing device keeps monitoring and analyzing the user's acoustic environment and stops this wireless personal communication connection if the content-independent speaker voiceprint of this speaking person has not been further recognized for some amount of time, e.g. for a predetermined period of time such as a minute or several minutes. Thereby, for example, the privacy of the user may be protected from being further heard by the other conversation participants after the user or the other conversation participants have already left the room of conversation etc. Further, an automatic interruption of the wireless acoustic stream when the speaker voice is not being recognized anymore can also help to save energy in the hearing device or system.

According to an embodiment, if a wireless personal communication connection between the user's hearing device and communication devices of a number of other conversation participants is established, the user's hearing device keeps monitoring and analyzing the user's acoustic environment and interrupts the wireless personal communication connection to some of these communication devices depending on at least one predetermined ranking criterion, so as to form a smaller conversation group. The above-mentioned number may be a predetermined large number of conversation participants, such as 5 people, 7 people, 10 people, or more. It may, for example, be pre-set in the hearing system or device and/or individually selectable by the user. The at least one predetermined ranking criterion may, for example, include one or more of the following: a conversational (i.e. content-dependent) overlap; a directional gain determined by the user's hearing device so as to characterize an orientation of the user's head relative to the respective other conversation participant; a spatial distance between the user and the respective other conversation participant.

According to an embodiment, the method comprises presenting a user interface to the user for notifying the user about a recognized speaking person and for establishing, joining or leaving a wireless personal communication connection between the hearing device and one or more communication devices used by the one or more recognized speaking persons. The user interface may be presented as acoustical user interface by the hearing device itself and/or by a further user device, such as a smartphone, for example as graphical user interface.

Further aspects described herein relate to a computer program for a wireless personal communication using a hearing device worn by a user and provided with at least one microphone and a sound output device, which program, when being executed by a processor, is adapted to carry out the steps of the method as described above and in the following as well as to a computer-readable medium, in which such a computer program is stored.

For example, the computer program may be executed in a processor of a hearing device, which hearing device, for example, may be carried by the person behind the ear. The computer-readable medium may be a memory of this hearing device. The computer program also may be executed by a processor of a connected user device, such as a smartphone or any other type of mobile device, which may be a part of the hearing system, and the computer-readable medium may be a memory of the connected user device. It also may be that steps of the method are performed by the hearing device and other steps of the method are performed by the connected user device.

In general, a computer-readable medium may be a floppy disk, a hard disk, an USB (Universal Serial Bus) storage device, a RAM (Random Access Memory), a ROM (Read Only Memory), an EPROM (Erasable Programmable Read Only Memory) or a FLASH memory. A computer-readable medium may also be a data communication network, e.g. the Internet, which allows downloading a program code. The computer-readable medium may be a non-transitory or transitory medium.

A further aspect relates to a hearing system comprising a hearing device worn by a hearing device user, as described herein above and below, wherein the hearing system is adapted for performing the method described herein above and below. The hearing system may further include, by way of example, a second hearing device worn by the same user and/or a connected user device, such as a smartphone or other mobile device or personal computer, used by the same user.

According to an embodiment, the hearing device comprises: a microphone; a processor for processing a signal from the microphone; a sound output device for outputting the processed signal to an ear of the hearing device user; a transceiver for exchanging data with communication devices used by other conversation participants and optionally with the connected user device and/or with another hearing device worn by the same user.

It has to be understood that features of the method as described above and in the following may be features of the computer program, the computer-readable medium and the hearing system as described above and in the following, and vice versa.

These and other aspects will be apparent from and elucidated with reference to the embodiments described hereinafter.

FIG. 1 schematically shows a hearing system 10 including a hearing device 12 in the form of a behind-the-ear device carried by a hearing device user (not shown) and a connected user device 14, such as a smartphone or a tablet computer. It has to be noted that the hearing device 12 is a specific embodiment and that the method described herein also may be performed by other types of hearing devices, such as in-the-ear devices.

The hearing device 12 comprises a part 15 behind the ear and a part 16 to be put in the ear channel of the user. The part 15 and the part 16 are connected by a tube 18. In the part 15, a microphone 20, a sound processor 22 and a sound output device 24, such as a loudspeaker, are provided. The microphone 20 may acquire environmental sound of the user and may generate a sound signal, the sound processor 22 may amplify the sound signal and the sound output device 24 may generate sound that is guided through the tube 18 and the in-the-ear part 16 into the ear channel of the user.

The hearing device 12 may comprise a processor 26 which is adapted for adjusting parameters of the sound processor 22 such that an output volume of the sound signal is adjusted based on an input volume. These parameters may be determined by a computer program run in the processor 26. For example, with a knob 28 of the hearing device 12, a user may select a modifier (such as bass, treble, noise suppression, dynamic volume, etc.) and levels and/or values of these modifiers may be selected, from this modifier, an adjustment command may be created and processed as described above and below. In particular, processing parameters may be determined based on the adjustment command and based on this, for example, the frequency dependent gain and the dynamic volume of the sound processor 22 may be changed. All these functions may be implemented as computer programs stored in a memory 30 of the hearing device 12, which computer programs may be executed by the processor 22.

The hearing device 12 further comprises a transceiver 32 which may be adapted for wireless data communication with a transceiver 34 of the connected user device 14, which may be a smartphone or tablet computer. It is also possible that the above-mentioned modifiers and their levels and/or values are adjusted with the connected user device 14 and/or that the adjustment command is generated with the connected user device 14. This may be performed with a computer program run in a processor 36 of the connected user device 14 and stored in a memory 38 of the connected user device 14. The computer program may provide a graphical user interface 40 on a display 42 of the connected user device 14.

For example, for adjusting the modifier, such as volume, the graphical user interface 40 may comprise a control element 44, such as a slider. When the user adjusts the slider, an adjustment command may be generated, which will change the sound processing of the hearing device 12 as described above and below. Alternatively or additionally, the user may adjust the modifier with the hearing device 12 itself, for example via the knob 28.

The user interface 40 also may comprise an indicator element 46, which, for example, displays a currently determined listening situation.

Further, the transceiver 32 of the hearing device 12 is adapted to allow a wireless personal communication by voice between the user's hearing device 12 and other persons' hearing devices, in order to improve/enable their conversation (which includes not only a conversation of two people, but also talking in a group or listening to someone's speech etc.) under adverse acoustic conditions such as a noisy environment.

Figure 2:
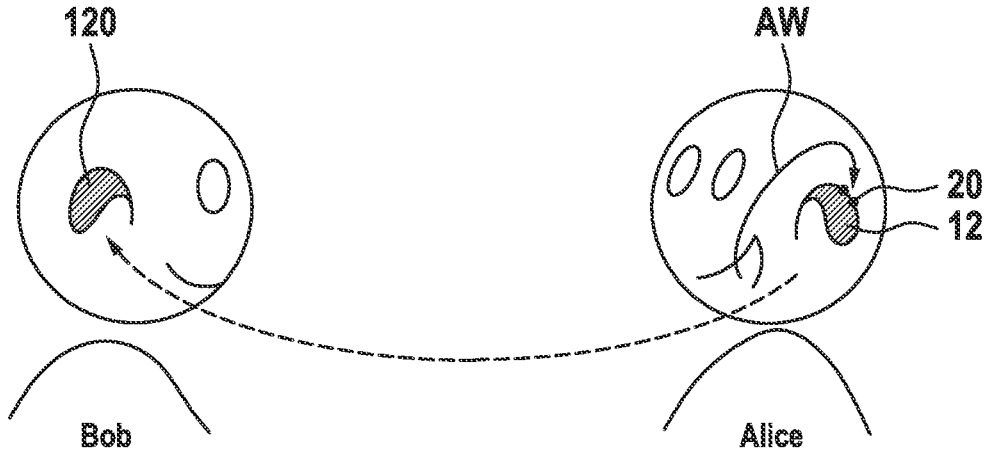
FIG. 2 schematically shows an example of two conversation participants (Alice and Bob) talking to each other via a wireless connection provided by their hearing devices.

This is schematically depicted in FIG. 2, which shows an example of two conversation participants (Alice and Bob) talking to each other via a wireless connection provided by their hearing devices 12 or, respectively, 120. As shown in FIG. 2, the hearing devices 12 and 120 are used as headsets which pick-up their user's voice with their integrated microphones and make the other communication participant's voice audible via the integrated loudspeaker. As indicated by a dashed arrow in FIG. 2, a voice audio stream is then wirelessly transmitted from a hearing device 12 of one user (Alice) to the other user's (Bob's) hearing device 120 or, in general, in both directions.

The hearing system 10 shown in FIG. 1 is adapted for performing a method for a wireless personal communication (e.g. as illustrated in FIG. 2) using a hearing device 12 worn by a user and provided with at least one integrated microphone 20 and a sound output device 24 (e.g. a loudspeaker).

Figure 3:
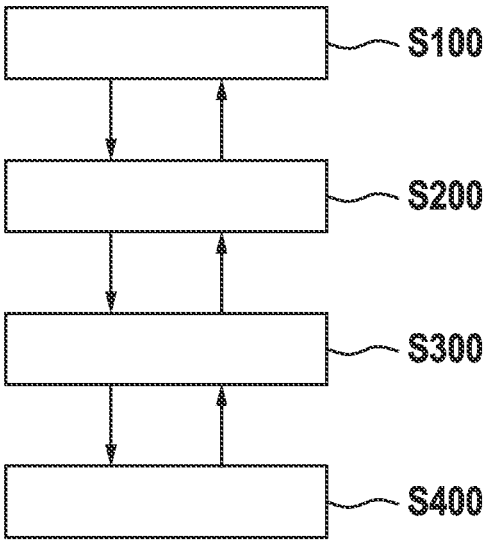
FIG. 3 shows a flow diagram of a method according to an embodiment for wireless personal communication via a hearing device of the hearing system of FIG. 1.

FIG. 3 shows an example for a flow diagram of this method. The method may be a computer-implemented method performed automatically in the hearing system 10 of FIG. 1.

In a first step S100 of the method, the user's acoustic environment is being monitored by the at least one microphone 20 and analyzed so as to recognize one or more speaking persons based on their content-independent speaker voiceprints saved in the hearing system 10 ("speaker recognition").

In a second step S200 of the method, this speaker recognition is used as a trigger to automatically establish, join or leave a wireless personal communication connection between the user's hearing device 12 and respective communication devices (such as hearing devices or wireless microphones) used by the one or more speaking persons (also denoted as "other conversation participants") and capable of wireless communication with the user's hearing device 12.

In step S200 it also may be that firstly a user interface is presented to the user, which notifies the user about a recognized speaking person and for establishing. With the user interface, the hearing device also may be trigger by the user for joining or leaving a wireless personal communication connection between the hearing device (12) and one or more communication devices used by the one or more recognized speaking persons.

In an optional third step S300 of the method, which may also be performed prior to the first and the second steps S100 and S200, the user's own content-independent voiceprint is obtained and saved in the hearing system 10.

In an optional fourth step S400, the user's own content-independent voiceprint saved in the hearing system 10 is being shared (i.e. exposed and/or transmitted) by wireless communication to the communication devices of potential other conversation participants, so as to enable them to recognize the user as a speaker, based on his own content-independent voiceprint.

In the following, each of the steps S100-S400, also including possible sub-steps, will be described in more detail with reference to FIGS. 4 to 6. Some or all of the steps S100-S400 or of their sub-steps may, for example, be performed simultaneously or be periodically repeated.

First of all, the above-mentioned analysis of the monitored acoustic environment of the user, which is performed by the hearing system 10 in step S100 and denoted as Speaker Recognition, will be explained in more detail:

Speaker recognition techniques are known as such from other technical fields. For example, they are commonly used in biometric authentication applications and in forensics, typically to identify a suspect on a recorded phone call (see, for example, J. H. Hansen and T. Hasan, "Speaker Recognition by Machines and Humans: A tutorial review," in IEEE Signal Processing Magazine (Volume: 32, Issue: 6), 2015).

Figure 4:
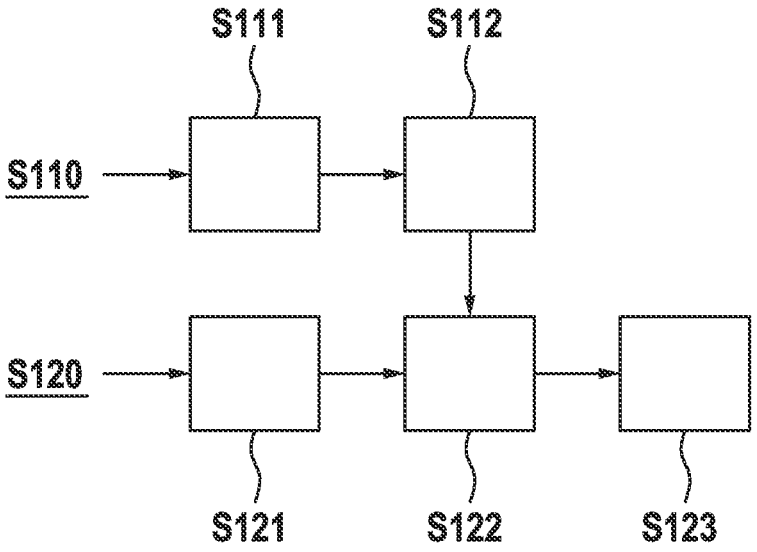
FIG. 4 shows a schematic block diagram of a speaker recognition method.

As schematically depicted in FIG. 4, a speaker recognition method may comprise two phases:

A training phase S110 where the speaker voice is modelled (as an example of generating the above-mentioned content-independent speaker voiceprint) and A testing phase S120 where unknown speech segments are tested against the model (so as to recognize the speaker as mentioned above).

The likelihood that the test segment was generated by the speaker is then computed and can be used to make a decision about the speaker's identity.

Therefore, as indicated in FIG. 4, the training phase S110 may include a sub-step S111 of "Features Extraction", where voice features of the speaker are extracted from his voice sample, and a sub-step S112 of "Speaker Modelling", where the extracted voice features are used for content-independent speaker voiceprint generation. The testing phase S120 may also include a sub-step S121 of "Features Extraction", where voice features of the speaker are extracted from his voice sample obtained from monitoring the user's acoustic environment, followed by a sub-step S122 of "Scoring", where the above-mentioned likelihood is computed, and a sub-step S123 of "Decision", where the decision is met whether the respective speaker is recognized or not based on said scoring/likelihood.

Regarding the Voice Features mentioned above, one of the most popular voice features used in speaker recognition are known as Mel-Frequency Cepstrum Coefficients (MFCCs) as they efficiently separate the speech content and the voice. In Fourier analysis, the Cepstrum is known as a result of computing the inverse Fourier transform of the logarithm of a signal spectrum. The Mel frequency is very close to the Bark domain, which is commonly used in hearing devices. It comprises grouping the acoustic frequency bins on a logarithmic scale to reduce the dimensionality of the signal. In opposition to the Bark domain, the frequencies are grouped using overlapping triangular filters. If the hearing devices already implement the Bark domain, the Bark Frequency Cepstrum Coefficients (BFCC) can be used for the features which would save some computation. For example, F. u. R. S. K. A. M. &. G. S. Chandar Kumar, "Analysis of MFCC and BFCC in a Speaker Identification System," as disclosed in iCoMET, 2018, have compared the performance of MFCC and BFCC based speaker identification and revealed the BFCC based speaker identification as generally suitable, too.

The Cepstrum coefficients may then be computed as follows:

$$c_k = \mathcal{F}^{-1}(\log g_{|X|}(X(f)))$$

where X(f) is the (Mel- or Bark-) Frequency domain representation of the signal and $\mathcal{F}^{-1}$ is the inverse Fourier transform. More insight on the Cepstrum is given, for example, in R. W. S. Alan V. Oppenheim, "From Frequency to Quefrency: A History of the Cepstrum," IEEE Signal Processing Magazine, no. September, pp. 95-106, 2004.

Here, it should be noted that sometimes the inverse Fourier transform is replaced by the discrete cosine transform (DCT) which may reduce even more aggressively the dimensionality. In both cases, suitable digital signal processing techniques, which embed hardware support for the computation, are basically known as implementable.

Other voice features which can be alternatively or additionally included in steps S111 and S121 to improve the recognition performances may, for example, be one or more of the following: LPC coefficients (Linear Predictive Coding coefficients), Pitch, Timbre.

In step S112 of FIG. 4, the extracted voice features are used to build a model that best describes the observed voice features for a given speaker.

Several modelling techniques may be found in the literature. One of the most commonly used is the Gaussian Mixture Model (GMM). A GMM is a weighted sum of several Gaussian PDFs (Probability Density Functions), each represented by mean vector and weight vectors and a covariance matrix computed during the training phase S110 in FIG. 4. If some of these computation steps are too time- or energy-consuming or too expensive to be implemented in the hearing device 12, they may also be swapped to the connected user device 14 (cf. FIG. 1) of the hearing system 10 and/or be executed offline (i.e. not in real-time during the conversation). That is, as it will be presented in the following, the model computation might be done offline.

On the other hand, the computation of the likelihood that an unknown test segment matches the given the speaker model (cf. step S122 in FIG. 4) might need to be performed in real-time by the hearing devices. For example, this computation may need to be performed during the conversation of persons like Alice and Bob in FIG. 3 by their hearing devices 12 or, respectively, 120 or by their connected user devices 14 such as smartphones (cf. FIG. 1).

In the present example, said likelihood to be computed is equivalent to the probability of the observed voice feature vector x in the given voice model λ (the latter is the content-independent speaker voiceprint saved in the hearing system 10). For a Gaussian mixture as mentioned above, it means to compute the probability as follows:

$$p(x \mid \lambda) = \sum_{g=1}^{M} \pi_g N\left(x \mid \mu_g, \sum_g\right) = \sum_{g=1}^{M} \pi_g \frac{1}{(2\pi)^{K/2} \det(\sum_g)^{1/2}} e^{-\frac{1}{2}(x-\mu_g)^T \sum_g^{-1} (x-\mu_g)}$$

wherein the meaning of the variables is as follows:

g=1 . . . M the Gaussian component indices $\pi_g$ the weight of the gth Gaussian mixture N the multi-dimensional Gaussian function $\mu_g$ the mean vector of the gth Gaussian mixture $\Sigma_g$ the covariance matrix of the gth Gaussian mixture K the size of the feature vector The complexity of computing the likelihood with a reasonable amount of approximately 10 features might be too time-consuming or too expensive for a hearing device. Therefore, the following different approaches may be further implemented in the hearing system 10 in order to effectively reduce this complexity:

One of the approaches could be to simplify the model to a multivariate Gaussian (M=1) where either: the features are independent with different means but equal variances ($\Sigma=\sigma^2 \cdot I$) or the features covariance matrices are equal ($\Sigma_i=\Sigma$, $\forall i$).

In those cases, the discriminant function simplifies to a linear separator (hyperplane) to which the feature position needs to be computed (see more details for this in the following).

A so-called Support Vector Machine (SVM) classifier may be used in speaker recognition in step S120. Here, the idea is to separate the speaker model from the background with a linear decision boundary; also known as a hyperplane. Additional complexity would then be added during the training phase of step S110, but the test in step S120 would be greatly simplified as the observed feature vectors can be tested against linear function. See the description of testing using a linear classifier in the following.

Depending on the overall performances, a suitable non-parametric density estimation, e.g. known as k-NN and Parzen window, may also be implemented.

As mentioned above, the complexity of the likelihood computation in step S120 may be largely reduced by using an above-mentioned Linear Classifier.

That is, the output of a linear classifier is given by the following equation:

$$g(w^T x+w_0)$$

wherein the meaning of the variables is as follows:

g a non-linear activation function x the observed voice feature vector w a predetermined vector of weights $w_0$ a predetermined scalar bias.

If g in the above equation is the sign function, the decision in step S123 of FIG. 4 is given by:

$$w^T x+w_0 \geq 0$$

As one readily recognizes, the complexity of the decision in the case of a linear classifier is pretty low. That is, the order of magnitude is K MACs (multiply-accumulate) where K is the size of the voice feature vector.

Figure 5:
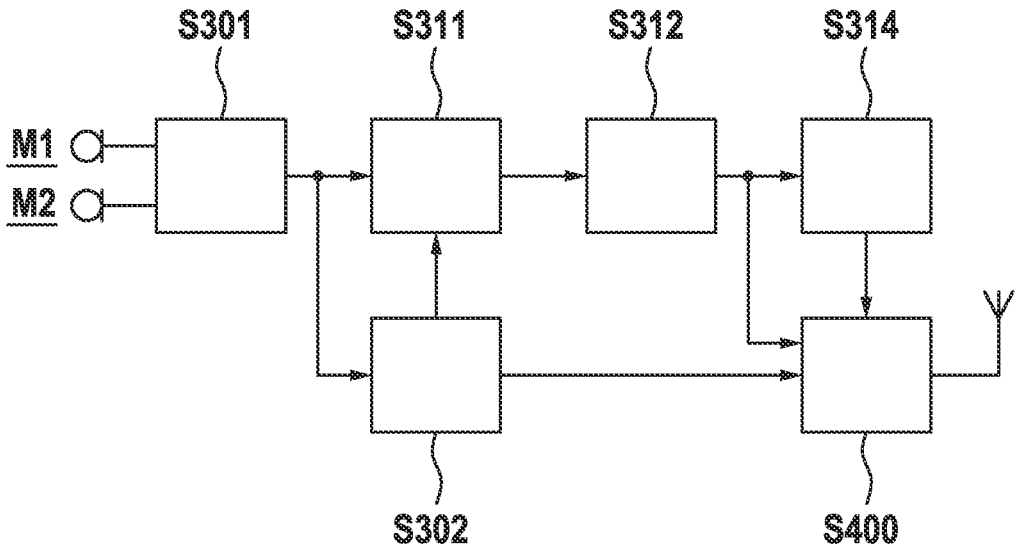
FIG. 5 shows a schematic block diagram of creating the user's own content-independent voiceprint, according to an embodiment.

With reference to FIG. 5, the specific application and implementation of the training phase (cf. step S110 in FIG. 4) to create the user's own content-independent voiceprint (cf. step S300 in FIG. 3) will be explained.

As already mentioned herein above, the user's own voice signature (content-independent voiceprint) may be obtained in different situations, such as:

During a fitting session at a hearing care professional's office. Thereby, the complexity of the model computation can be pushed to the fitting station. However, the model is created in a quiet environment.

During Own Voice Pick Up (OVPU) use cases like phone calls, wherein the hearing device's beamformers may be tuned to pickup the user's own voice and filter out ambient noises.

Thereby, the model can be improved over time in real life situations. However, the model in general needs to be computed online, i.e. when the user is using his hearing device 12. This may be implemented to be executed in the hearing devices 12 themselves or by the user's phone (as an example of user connected device 14 in FIG. 1).

It should be noted, that if the model computation is pushed to the mobile phone, at least two approaches can be implemented in the hearing system 10 of FIG. 1:

1) The hearing device 12 extracts the features and transmits them to the phone. Then, the phone computes/updates the speaker model and transmits it back to the hearing device 12.

2) The phone app listens to the phone calls, with user consent, and handles the feature extraction part in addition to the modelling.

These sub-steps of step S300 are schematically indicated in FIG. 5. In sub-step S301, an ambient acoustic signal acquired by microphones M1 and M2 of the user's hearing device 12 in a situation where the user himself is speaking is pre-processed in any suitable manner. This pre-processing may, for example, include noise cancelling (NC) and/or beam forming (BF) etc.

A detection of Own Voice Activity of the user may, optionally, be performed in a sub-step S302, so as to ensure that the user is speaking, e.g. by identifying a phone call connection to another person and/or by identifying a direction of an acoustic signal as coming from the user's mouth.

Similarly to steps S111 and S112 generally described above with reference to FIG. 4, a user's voice feature extraction is then performed in step S311, followed by modelling his voice in step S312, i.e. creating his own content-independent voiceprint.

In step S314, the model of the user's voice may then be saved in a non-volatile memory (NVM), e.g. of the hearing device 12 or of the connected user device 14, for future use. To be exploited by communication devices of other conversation participants, it may be shared with them in step S400 (cf. FIG. 3), e.g. by the transceiver 32 of the user's hearing device 12. In this step S400, the model may: be exchanged during a pairing of different persons' hearing devices in a wireless personal communication network; and/or be broadcasted periodically; and/or be sent on request in a Bluetooth Low Energy scan response manner whenever the hearing devices are available for entering an existing or creating a new wireless personal communication network.

As indicated in FIG. 5, the sharing of the user's own voice model with potential other conversation participants' devices in step S400 may also be implemented to additionally depend on whether the user is speaking or not, as detected in step S302. Thereby, for example, energy may be saved by avoiding unnecessary model sharing in situation where the user is not going to speak himself, e.g. when he/she is only listening to a speech or lecture given by another speaker.

Figure 6:
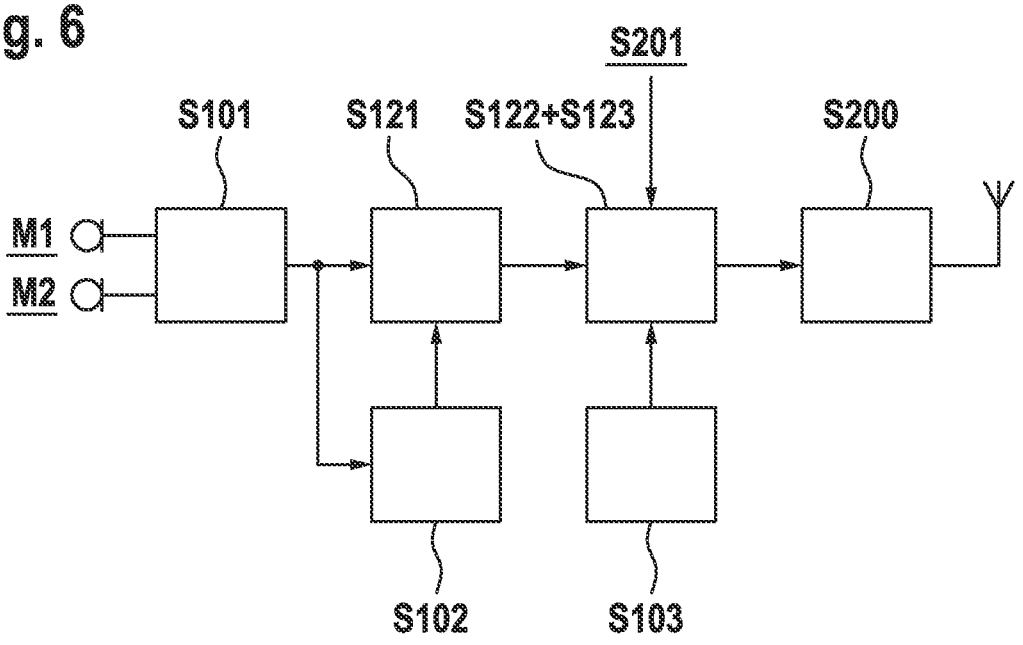
FIG. 6 shows a schematic block diagram of verifying a speaker and, depending on the result of this speaker recognition, an automatic establishment or leaving of a wireless communication connection to the speaker's communication device, according to an embodiment.

With reference to FIG. 6, the specific application of the testing phase (cf. step S120 in FIG. 4) so as to verify a speaker by the user's hearing system 10 and, depending on the result of this speaker recognition, an automatic establishment or leaving of a wireless communication connection to the speaker's communication device (cf. step S200 in FIG. 3) will be explained and further illustrated using some exemplary use cases.

In a face-to-face conversation between two people equipped with hearing devices capable of digital audio radio transmission, such as in the case of Alice and Bob in FIG. 2, the roles "speaker" and "listener" may be defined at a specific time during the conversation. The listener is defined as the one receiving acoustically the speaker voice. At the specific time moment shown in FIG. 2, Alice is a "speaker", as indicated by an acoustic wave AW leaving her mouth and received by the microphone(s) 20 of her hearing device 12 so as to wirelessly transmit the content to Bob, who is the "listener" in this situation.

The testing phase activity is performed in FIG. 6 by listening. It is based on the signal received by microphones M1 and M2 of the user's hearing device 12 as they monitor the user's acoustic environment. In sub-step S101, the acoustic signal received by the microphones M1 and M2 may be pre-processed in any suitable manner, such as e.g. noise cancelling (NC) and/or beam forming (BF) etc. The listening comprises in FIG. 6 in extracting voice features from the acoustic signal of interest, i.e. beamformer signal output in this example, and computing the likelihood with the known speaker models stored in NVM. For example, the speaker voice features may be extracted in a step S121 and the likelihood be computed in a step S122 in order to meet a decision about the speaker recognition in step 123, similar to those steps described above with reference to FIG. 4.

As indicated in FIG. 6, an additional sub-step S102, "Speaker Voice Activity Detection", where the presence of a speaker's voice may be detected prior to extracting its features in step S121 and an additional sub-step S103, where the speaker voice model (content-independent voiceprint), for example saved in the non-volatile-memory (NVM), is provided to the decision unit, in which the analysis of steps S122 and S123 are implemented, may be optionally included in the speaker recognition procedure.

As mentioned above, in step S200 (cf. also FIG. 2), the speaker recognition performed in steps S122 and S123 is used as a trigger to automatically establish, join or leave a wireless personal communication connection between the user's hearing device 12 and respective communication devices of the recognized speakers. This connection may be implemented to include further sub-steps S201 which may help to further improve said wireless personal communication. This may, for example, include monitoring some additional conditions such as a signal-to-noise ratio (SNR), or a Noise Floor Estimation (NFE).

In the following, some examples of different use cases where the proposed method may be beneficial, will be described:

Establishing a Wireless Personal Communication Stream in Step S200:

If the listener's hearing system 10 detects that the recognized speaker's device is known to be wireless network compatible, the listener's hearing device 12 or system 10 may request the establishment of a wireless network connection to the speaker's device or to join an existing one, if any, depending on acoustic parameters such as the ambient signal-to-noise ratio (SNR) and/or on the result of classifiers in the hearing device 12, which may identify a scenario, such as persons inside car, outdoors, wind noise, so that the decision is made based on the identified scenario.

Leaving a Wireless Personal Communication Network in step S200:

While consuming a digital audio stream in the network, the listener's hearing device 12 keeps analysing the acoustic environment. If the active speaker voice signature is not present in the acoustic environment for some amount of time, the hearing device 12 may leave the wireless network connection to this speaker's device in order to maintain privacy and/or save energy.

Splitting a Wireless Personal Communication Group in Step S200:

If a Wireless Personal Communication Network may grow automatically as users join the network, it may also split itself in smaller networks. If groups of four to six people can be identified in some suitable manner, it may be implemented in the hearing device network to split up and separate the conversation participants into such smaller conversation groups.

In such a situation, a person will naturally orient his head in the direction of the group of his interest which gives an advantage in terms of directional gain. Therefore, when several people are talking at the same time in a group, a listener's hearing device(s) might be able to rank the speakers according to their relative gain.

Based on such ranking and on the conversations overlap, the hearing device(s) may decide to drop the stream of the more distant speaker.

To sum up briefly, the novel method disclosed herein may be performed by a system being a combination of a hearing device and a connected user device such as a smartphone, a personal or a tablet computer. The smartphone or the computer may, for example, be connected to a server providing voice models/voice imprints, herein denoted as "content-independent voiceprints". The analysis described herein (i.e. one or more of the analysis steps such as voice feature extraction, voice model development, speaker recognition, assessment of further conditions such as SNR) may be done in the hearing device and/or it may be done in the connected user device. Voice models/imprints may be stored in the hearing device or in the connected user device. The comparison of detected voice model and stored voice model may be implemented/done in the hearing device and/or in the connected user device.

While the invention has been illustrated and described in detail in the drawings and foregoing description, such illustration and description are to be considered illustrative or exemplary and not restrictive; the invention is not limited to the disclosed embodiments. Other variations to the disclosed embodiments can be understood and effected by those skilled in the art and practicing the claimed invention, from a study of the drawings, the disclosure, and the appended claims. In the claims, the word "comprising" does not exclude other elements or steps, and the indefinite article "a" or "an" does not exclude a plurality. A single processor or controller or other unit may fulfill the functions of several items recited in the claims. The mere fact that certain measures are recited in mutually different dependent claims does not indicate that a combination of these measures cannot be used to advantage. Any reference signs in the claims should not be construed as limiting the scope.

LIST OF REFERENCE SYMBOLS

10 hearing system
12, 120 hearing device(s)
14 connected user device
15 part behind the ear
16 part in the ear
18 tube
20, M1, M2 microphone(s)
22 sound processor
24 sound output device
26 processor
28 knob
30 memory
32 transceiver
34 transceiver
36 processor
38 memory
40 graphical user interface
42 display
44 control element, slider
46 indicator element
AW acoustic wave

What is claimed is:

1. A method for a wireless personal communication using a hearing system, the hearing system comprising a hearing device worn by a user, the method comprising:

monitoring and analyzing an acoustic environment of the user by the hearing device to recognize one or more speaking persons based on content-independent speaker voiceprints saved in the hearing system; and depending on the speaker recognition, establishing, joining or leaving a wireless personal communication connection between the hearing device and one or more communication devices used by the one or more recognized speaking persons.

2. The method of claim 1, further comprising:

the communication devices capable of wireless communication with the user's hearing device include hearing devices and/or wireless microphones used by the other conversation participants; and/or beam formers specifically configured and/or tuned so as to improve a signal-to-noise ratio of a wireless personal communication between persons not standing face to face and/or separated by more than 1.5 m are employed in the user's hearing device and/or in the communication devices of the other conversation participants.

3. The method of claim 1, wherein the user's own content-independent voiceprint is also saved in the hearing system and is being shared by wireless communication with the communication devices used by potential conversation participants so as to enable them to recognize the user based on his own content-independent voiceprint.

4. The method of claim 3, wherein the user's own content-independent voiceprint is saved in a non-volatile memory of the user's hearing device or of a connected user device; and/or is being shared with the communication devices of potential conversation participants by one or more of the following:

an exchange of the user's own content-independent voiceprint and the respective content-independent speaker voiceprint when the user's hearing device is paired with a communication device of another conversation participant for wireless personal communication;

a periodical broadcast performed by the user's hearing device at predetermined time intervals;

sending the user's own content-independent voiceprint on requests of communication devices of potential other conversation participants.

5. The method of claim 3, wherein the user's own content-independent voiceprint is obtained using a professional voice feature extraction and voiceprint modelling equipment at a hearing care professional's office during a fitting session; and/or using the user's hearing device and/or the connected user device for voice feature extraction during real use cases in which the user is speaking.

6. The method of claim 5, wherein the user's own content-independent voiceprint is obtained by using the user's hearing device and/or the connected user device for voice feature extraction during real use cases in which the user is speaking and using the connected user device for voiceprint modelling, wherein:

the user's hearing device extracts the voice features and transmits them to the connected user device, whereupon the connected user device computes or updates the voiceprint model and transmits it back to the hearing device; or the connected user device employs a mobile application which monitors the user's phone calls and/or other speaking activities and performs the voice feature extraction part in addition to the voiceprint modelling.

7. The method of claim 1, wherein, beside said speaker recognition, one or more further acoustic quality and/or personal communication conditions which are relevant for said wireless personal communication are monitored and/or analysed in the hearing system; and the steps of automatically establishing, joining and/or leaving a wireless personal communication connection between the user's hearing device and the respective communication devices of other conversation participants further depend on said further conditions.

8. The method of claim 7, wherein said further conditions include:

ambient signal-to-noise ratio; and/or presence of a predefined environmental scenario pertaining to the user and/or other persons and/or surrounding objects and/or weather, wherein such scenarios are identifiable by respective classifiers provided in the hearing device or hearing system.

9. The method of claim 1, wherein, once a wireless personal communication connection between the user's hearing device and a communication device of another speaking person is established, the user's hearing device keeps monitoring and analyzing the user's acoustic environment and drops this wireless personal communication connection if the content-independent speaker voiceprint of this speaking person has not been recognized anymore for a predetermined interval of time.

10. The method of claim 1, wherein, if a wireless personal communication connection between the user's hearing device and communication devices of a number of other conversation participants is established, the user's hearing device keeps monitoring and analyzing the user's acoustic environment and drops the wireless personal communication connection to some of these communication devices depending on at least one predetermined ranking criterion, so as to form a smaller conversation group.

11. The method of claim 10, wherein the at least one predetermined ranking criterion includes one or more of the following:

conversational overlap;

directional gain determined by the user's hearing device so as to characterize an orientation of the user's head relative to the respective other conversation participant;

spatial distance between the user and the respective other conversation participant.

12. The method of claim 1, further comprising:

presenting a user interface to the user for notifying the user about a recognized speaking person and for establishing, joining or leaving a wireless personal communication connection between the hearing device and one or more communication devices used by the one or more recognized speaking persons.

13. A computer program product for a wireless personal communication using a hearing device worn by a user and provided with at least one microphone and a sound output device, which program, when being executed by a processor, is adapted to carry out the steps of the method of claim 1.

14. A hearing system comprising a hearing device worn by a hearing device user and optionally a connected user device, wherein the hearing device comprises:

a microphone;

a processor for processing a signal from the microphone;

a sound output device for outputting the processed signal to an ear of the hearing device user;

a transceiver for exchanging data with communication devices used by other conversation participants and optionally with the connected user device; and wherein the hearing system is adapted for performing the method of claim 1.

* * * * *